US012251057B2

(12) United States Patent
Seki

(10) Patent No.: US 12,251,057 B2
(45) Date of Patent: Mar. 18, 2025

(54) ROLL PAPER HOLDER

(71) Applicant: Norio Seki, Shizuoka (JP)

(72) Inventor: Norio Seki, Shizuoka (JP)

( * ) Notice: Subject to any disclaimer, the term of this patent is extended or adjusted under 35 U.S.C. 154(b) by 434 days.

(21) Appl. No.: 17/711,187

(22) Filed: Apr. 1, 2022

(65) Prior Publication Data

US 2023/0309759 A1 Oct. 5, 2023

(51) Int. Cl.
*A47K 10/36* (2006.01)

(52) U.S. Cl.
CPC .... *A47K 10/3643* (2013.01); *A47K 2010/365* (2013.01); *A47K 2010/3675* (2013.01)

(58) Field of Classification Search
CPC ..... A47K 10/3643; A47K 2010/3675; A47K 2010/365; B65H 35/0073; B65H 35/0033; B65H 35/0026; B26F 3/02
USPC ..... 225/73, 34, 35, 89; 156/523, 574.577, 156/579
See application file for complete search history.

(56) References Cited

U.S. PATENT DOCUMENTS 2,582,980 A * 1/1952 Fritzinger ..... B65H 35/0033 226/127
2,606,682 A * 8/1952 Cutter ..... B65H 35/0033 83/252
2,832,549 A * 4/1958 Youngberg ..... A47K 10/38 225/85
3,419,201 A * 12/1968 Brandon ..... A47K 10/32 225/93
4,253,905 A * 3/1981 Regan ..... B65H 35/0026 156/577

FOREIGN PATENT DOCUMENTS

JP 2006-141921 A 6/2006

OTHER PUBLICATIONS

Seki, Norio; https://www.makuake.com/project/sawaranaide; Crowd funding page posted to World Wide Web on Apr. 5, 2021; 10 pages (1 page partial English translation).

* cited by examiner

*Primary Examiner* — Ghassem Alie
(74) *Attorney, Agent, or Firm* — Harness, Dickey & Pierce, P.L.C.

(57) ABSTRACT

A roll paper holder includes: a blade member having a blade provided at an end of a base, a press projection provided at the other end of the base, and a convex portion provided on an upper surface of the base; a blade-member-storing case pivotally supporting the convex portion of the blade member; and a holder body to which a roll paper is attachable, in which the blade-member-storing case is mounted on an upper surface of the holder body with a base end pivotally supported by the holder body, and the blade-member-storing case has a cutout in a side thereof, the cutout being curved from a front end of the side to a lower portion of the side close to the base end of the blade-member-storing case.

5 Claims, 6 Drawing Sheets

ROLL PAPER HOLDER

BACKGROUND

Technical Field

The present invention relates to a roll paper holder that enables a user to attach and cut a roll paper without touching the roll paper holder and easily find a front end of the roll paper to facilitate pulling out the roll paper.

Background Art

In general, when a roll paper attached to a roll paper holder is cut by any length and then the remaining roll paper is used next time, since a front end of the roll paper left after being cut is hidden under a lid, it is often performed to rotate the roll paper by hand to pull out a front end of the roll paper a little, determine the front end, and pull out the roll paper. When cutting the roll paper with a blade, the lid applies a pressing force onto the roll paper from above the roll paper. Accordingly, the front end of the roll paper is likely to closely contact with the roll paper. If the roll paper in such a state is rotated by hand, the front end rotates together with the roll paper and the front end of the roll paper is difficult to determine visually. As a result, unless the roll paper is fast rotated several times by hand, the front end of the roll paper is sometimes difficult to peel off from the roll paper to hamper pull-out of the roll paper. Especially when the roll paper is a thin single-ply roll paper, a front end of the roll paper often sticks to the roll paper, so that it is often impossible to pull out the roll paper smoothly by picking the roll paper with fingertips.

In such a situation, it is often observed that, for the next user, the front end of the roll paper is folded into a triangular shape so as to be easily found by protruding from the lid. However, in these days when people dislike contact, this act, which is an indirect contact, is currently avoided.

Therefore, JP2006-141921 A has been proposed as a roll paper holder in which a front end of a roll paper can be easily pulled out and the front end can be pinched with fingertips by any user. In this structure, a horizontally long through hole is formed in a lid of the roll paper holder for a roll paper, and the front end of the roll paper is exposed from the through hole to a top surface of the lid and cut with a blade provided at a front end of the lid.

However, in JP2006-141921 A, when the front end of the roll paper is picked up with fingertips and pulled out, the roll paper is easily caught in the through hole and resistance at the time of pulling out is large, so that the roll paper cannot be pulled out smoothly, which currently hampers practical use.

Moreover, there has been a demand for development of a roll paper holder that enables a user to attach and cut a roll paper without touching the roll paper holder.

An object of the invention is to provide a roll paper holder that enables a user to attach and cut a roll paper without touching the roll paper holder, reliably cut the roll paper, and easily find a front end of the roll paper to facilitate pulling out the roll paper.

SUMMARY

According to an aspect of the invention, a roll paper holder includes: a blade member having a blade provided at an end of a base, a press projection provided at the other end of the base, and a convex portion provided on an upper surface of the base; a blade-member-storing case pivotally supporting the convex portion of the blade member; and a holder body to which a roll paper is attachable, in which the blade-member-storing case is mounted on an upper surface of the holder body with a base end pivotally supported by the holder body, and the blade-member-storing case has a cutout in a side thereof, the cutout being curved from a front end of the side to a lower portion of the side close to the base end of the blade-member-storing case.

With the above arrangement, the blade-member-storing case preferably includes: a top cover; a first side plate disposed at a first side of the top cover; a second side plate disposed at a second side of the top cover and having the cutout; and a connecting bar extending downward from the top cover and being pivotally supported by the holder body, and it is also preferable that a receiving portion with which the press projection of the blade member is engageable is formed on a lower surface of the top cover of the blade-member-storing case.

Alternatively, in the above aspect, the blade member may include a shaft at each end of the convex portion, and the blade-member-storing case includes: a top cover having an upper step; a support plate disposed under the top cover; a first side plate disposed at a first side of the top cover; a second side plate in a form of a projection piece disposed on a second side of the top cover; a connecting bar extending downward from the top cover and being pivotally supported by the holder body; and a guide for a roll paper that is provided at an end of the support plate opposite to the first side plate, in which the guide and the first side plate each have a hole and a headed pin is attached to the shaft through the hole. With the above arrangement, the roll paper holder preferably further includes a plate spring having one end fixed to the blade member and having the other end disposed in the blade-member-storing case. Moreover, it is preferable that the upper step of the top cover is smaller than a lower step in width and provided in a central portion of the lower step, and the blade and the base define a clearance therebetween that fingers enter to facilitate pinching a front end of the roll paper.

With the above arrangement, the roll paper holder includes: a blade member having a blade at an end of a base, a press projection provided at the other end of the base, and a convex portion provided on an upper surface of the base; a blade-member-storing case pivotally supporting the convex portion of the blade member; and a holder body to which a roll paper is attachable, in which the blade-member-storing case is mounted on an upper surface of the holder body with a base end pivotally supported by the holder body, and the blade-member-storing case has a cutout in a side thereof, the cutout being curved from a front end of the side to a lower portion of the side close to the base end of the blade-member-storing case. Accordingly, a user can attach and cut a roll paper without touching the roll paper holder, reliably cut the roll paper with a single hand, and easily find a front end of the roll paper to facilitate pulling out the roll paper. In particular, there is concern that the new coronavirus infection, which has become a problem these days, is likely to be transmitted when using toilet. However, since a user does not contact with the roll paper holder by using the product of the invention, infection with the new coronavirus is preventable.

With the above arrangement, the blade-member-storing case includes: the top cover; the support plate disposed under the top cover; the first side plate disposed at the first side of the top cover; the second side plate disposed at the second side of the top cover and having the cutout; and a connecting bar extending downward from the top cover and being pivotally supported by the holder body. Accordingly, a user can easily attach and cut a roll paper without touching the roll paper holder.

With the above arrangement, the receiving portion with which the press projection of the blade member is engageable is provided on a lower surface of the top cover of the blade-member-storing case. Accordingly, since a roll paper can be cut in a stationary condition, the roll paper can be more reliably cut even with a single hand.

With the above arrangement, the blade member includes the shaft at each end of the convex portion, and the blade-member-storing case includes: the top cover having the upper step; the support plate disposed under the top cover; the first side plate disposed at the first side of the top cover; the second side plate in a form of a projection piece disposed on the second side of the top cover; the connecting bar extending downward from the top cover and being pivotally supported by the holder body; and the guide for a roll paper that is provided at an end of the support plate opposite to the first side plate, in which the guide and the first side plate each has a hole and a headed pin is attached to the shaft through the hole. Accordingly, in addition to the same effects as above, a roll paper can be attached more smoothly and pulled out more easily.

With the above arrangement, the upper step of the top cover is smaller than the lower step in width and provided in the central portion of the lower step, and the blade and the base define a clearance therebetween that fingers enter to facilitate pinching a front end of the roll paper. Accordingly, a roll paper is pulled out further easily.

DETAILED DESCRIPTION

Figure 1:
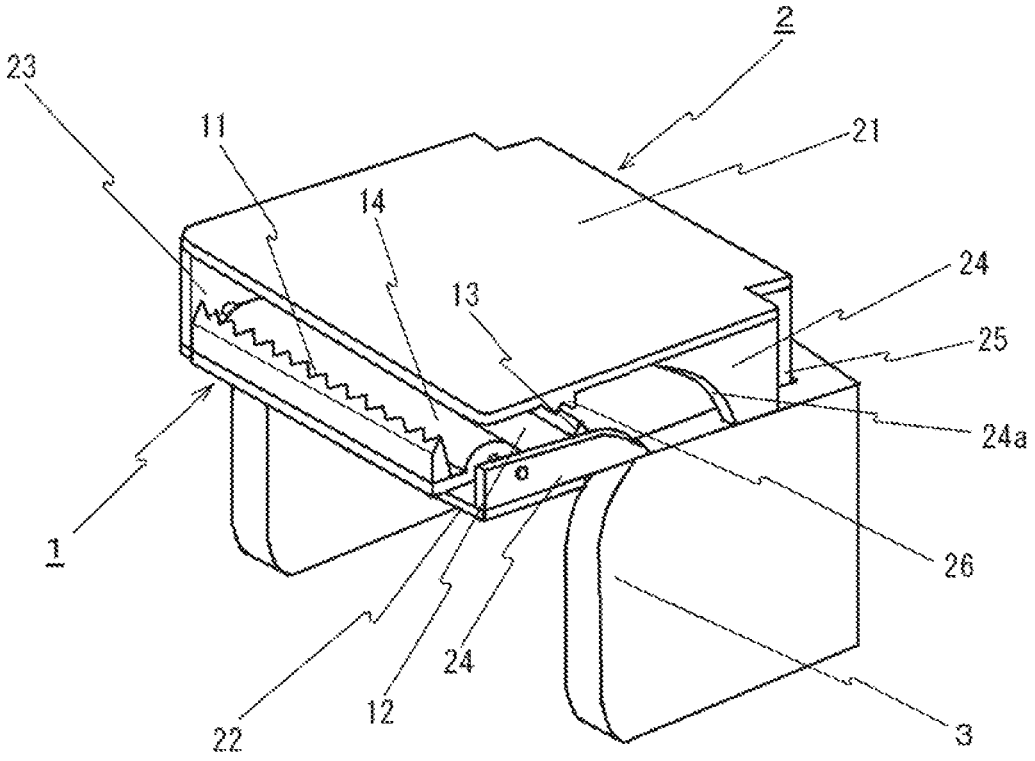
FIG. 1 is a perspective view showing an exemplary embodiment of the invention.
Figure 2:
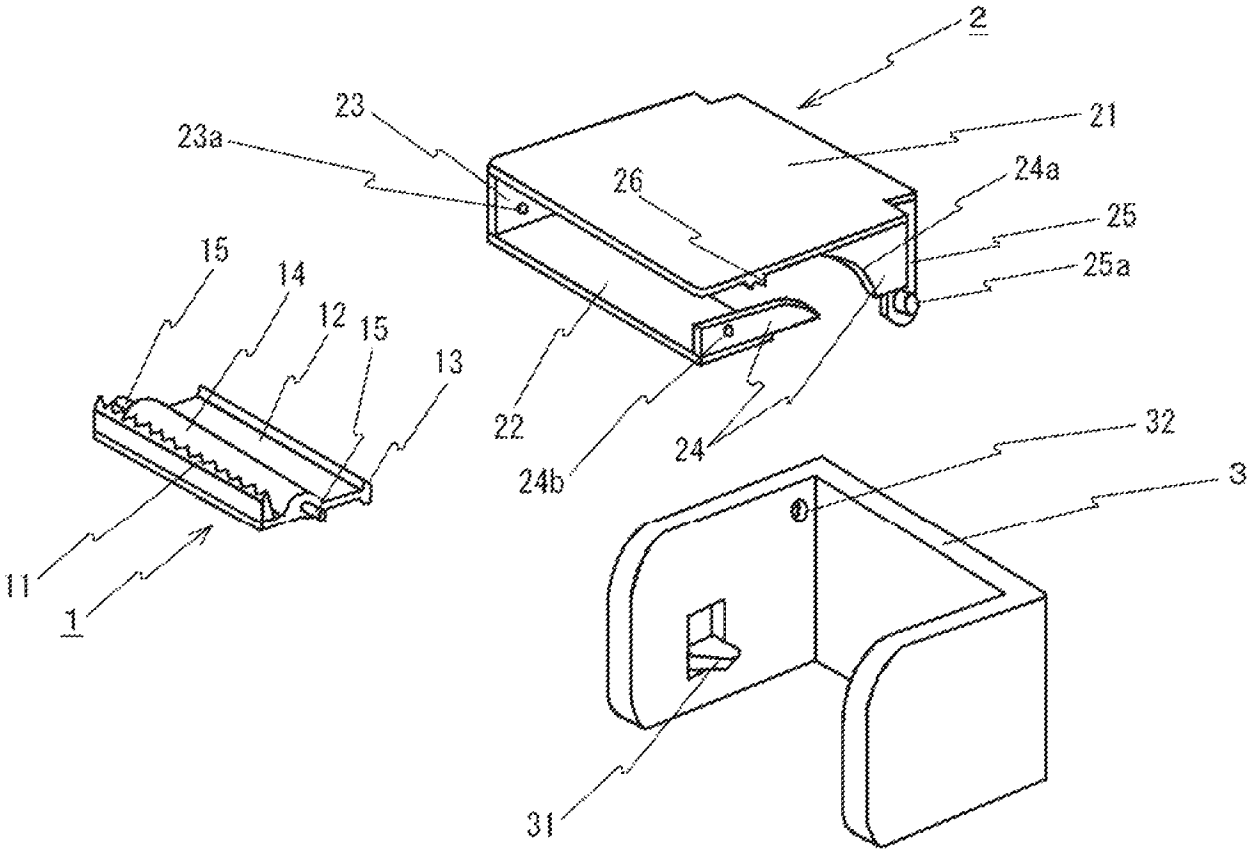
FIG. 2 is a perspective view showing disassembled parts in the exemplary embodiment.

An exemplary embodiment of the invention will be described with reference to FIGS. 1 and 2. 1 denotes a blade member manufactured using a synthetic resin. The blade member 1 includes a blade 11, a plate-shaped base 12, a press projection 13, a convex portion 14, and shafts 15, in which the blade 11 is provided at a front end of the base 12, the press projection 13 is provided at a rear end of the base 12 and projects at least upward, the convex portion 14 is provided in the middle of an upper surface of the base 12, and the shafts 15 are provided at respective ends of the convex portion 14. When a particularly soft synthetic resin such as a urethane resin and rubber is used as a material of the blade 11, the blade 11 can cut a roll paper more reliably to provide a sharp cutting surface. Each shaft 15 is shaped in a stick with a round end and projects from the convex portion 14. A position of the shaft 15 is preferably determined so that a gravity center of the blade member 1 is posterior to the shaft 15.

2 denotes a blade-member-storing case manufactured using a synthetic resin. The blade-member-storing case 2 pivotally supports the shafts 15 of the blade member 1 with respective front portions of side plates 23, 24. The blade-member-storing case 2 includes a top cover 21 shaped in a plate, a rectangular support plate 22 disposed under a front portion of the top cover 21, the side plate 23 disposed on a left side of the top cover 21, the side plate 24 disposed on a right side of the top cover 21 and having a cutout 24*a*, and a pair of connecting bars 25 at a right rear portion and a left rear portion of top cover 21 in a manner to extend downward, each connecting bar 25 having a shaft 25*a* at a lower portion. Moreover, a receiving portion 26 for engagement with the press projection 13 is provided in the middle of a lower surface of the top cover 21. The cutout 24*a* formed in the side plate 24 is curved from the front portion of the side plate 24 toward a lower rear portion of the side plate 24. Moreover, holes 23*a*, 24*b*, into which the shafts 15 are to be inserted, are drilled in the front portions of the side plates 23, 24, respectively.

3 denotes a holder body to which a roll paper is attachable with a single touch. The holder body 3 includes: a pair of roll-supporting projection pieces 31 movably supporting a roll up and down or back and forth; and a pair of bearings 32 pivotally supporting the respective lower portions of the connecting bars 25 of the blade-member-storing case 2. Lower portions of the respective side plates 23, 24 of the blade-member-storing case 2 are mounted on an upper surface of the holder body 3.

Figure 5:
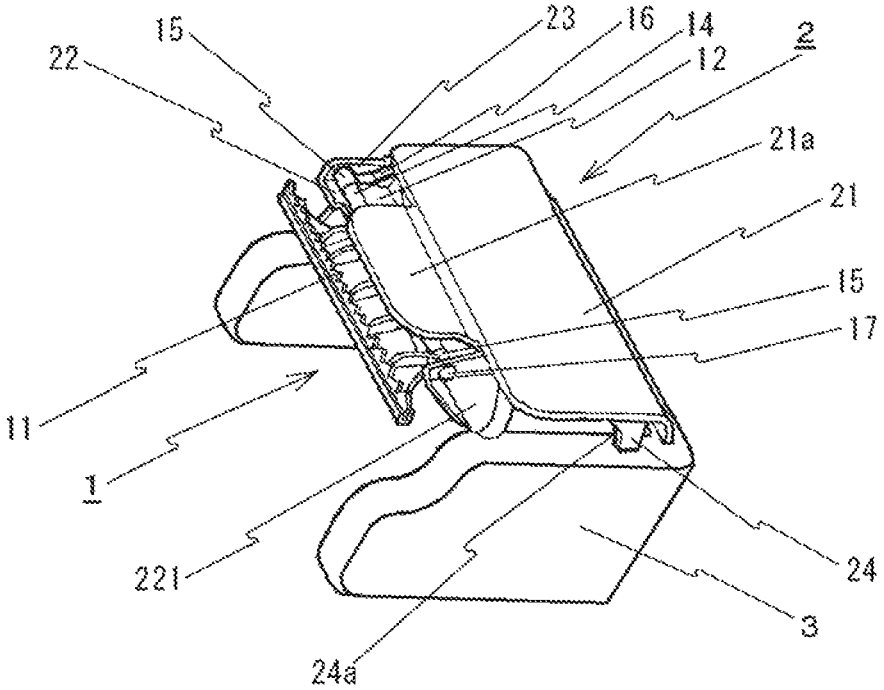
FIG. 5 is a perspective view showing another exemplary embodiment of the invention.
Figure 6:
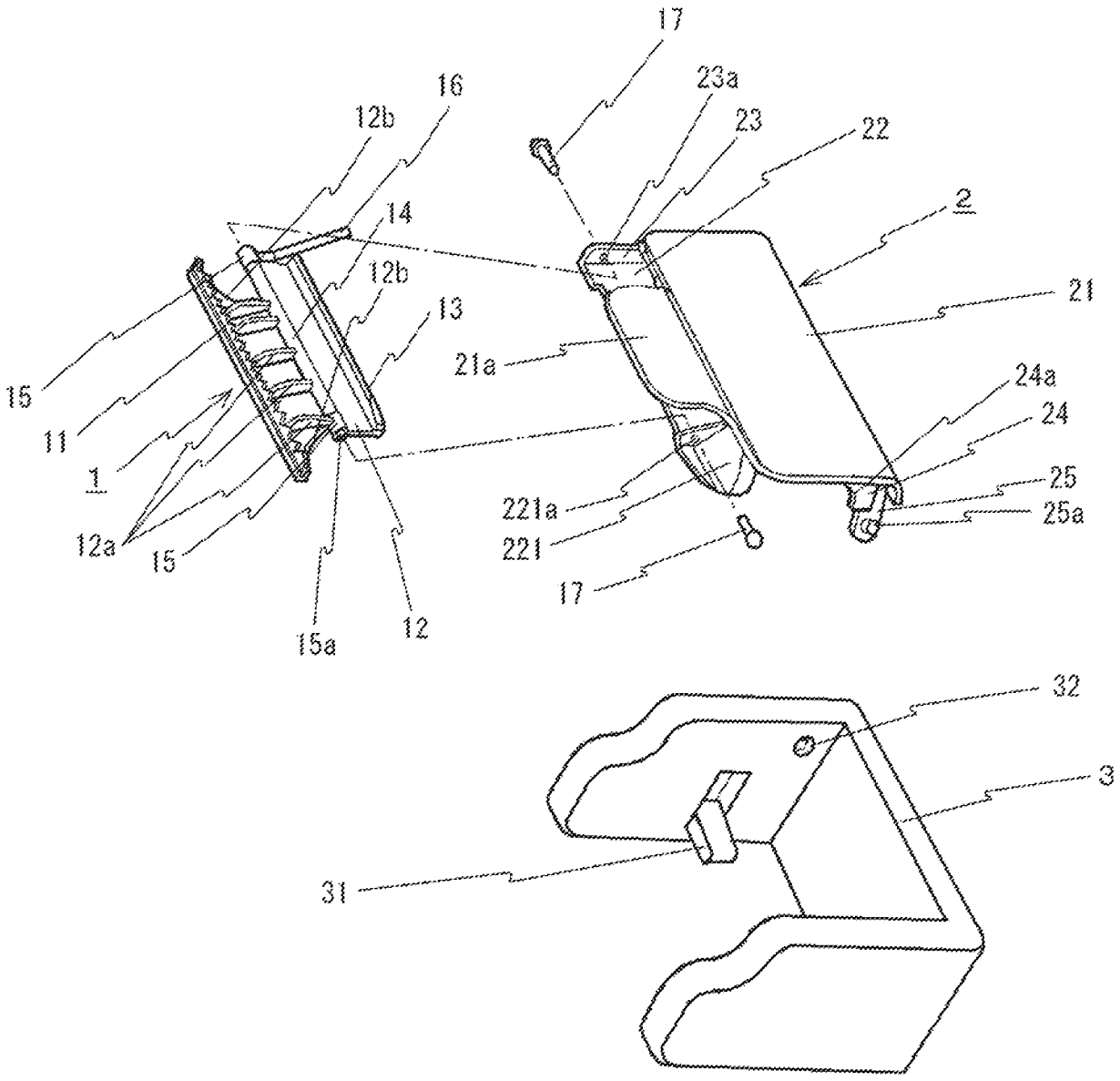
FIG. 6 is a perspective view showing disassembled parts in the another exemplary embodiment.

FIGS. 5 and 6 show another exemplary embodiment in which the blade member 1 and the blade-member-storing case 2 are structurally the same as those in the above exemplary embodiment but details are different from those in above exemplary embodiment. Specifically, the blade 11 of the blade member 1 is provided via a plurality of projection pieces 12*a* at the front end of the base 12. Here, a clearance 12*b* that allows fingers to easily enter is defined on each side between the blade 11 and the base 12. The press projection 13 is provided at the rear end of the base 12. The convex portion 14 is provided in the middle of the upper surface of the base 12. The shaft 15 is provided at each of ends of the convex portion 14. The insertion hole 15*a* is drilled in the center of the shaft 15. A headed pin 17 is inserted in the insertion hole 15*a* to serve as a shaft. Moreover, a plate spring 16 is provided so that one end thereof is fixed on the base 12 and the other end thereof is in contact with a lower surface of the top cover 21.

Any holder body to which a roll paper is attachable with a single touch is usable as the holder body 3.

The top cover 21 of the blade-member-storing case 2 includes an upper step 21*a* and a lower step that are integrally formed. The upper step 21*a* is a front portion of the top cover 21 and is higher than the lower step. A width of the upper step 21*a* is smaller than that of the lower step. A guide 221 for assisting an easy setting of a roll paper is provided at a right end of the support plate 22. A hole 221*a* into which the headed pin 17 is to be inserted is drilled in the guide 221. The side plate 24 is in a form of a projection piece. The blade-member-storing case in this exemplary embodiment is otherwise the same as the blade-member-storing case 2 in the above exemplary embodiment.

Figure 3:
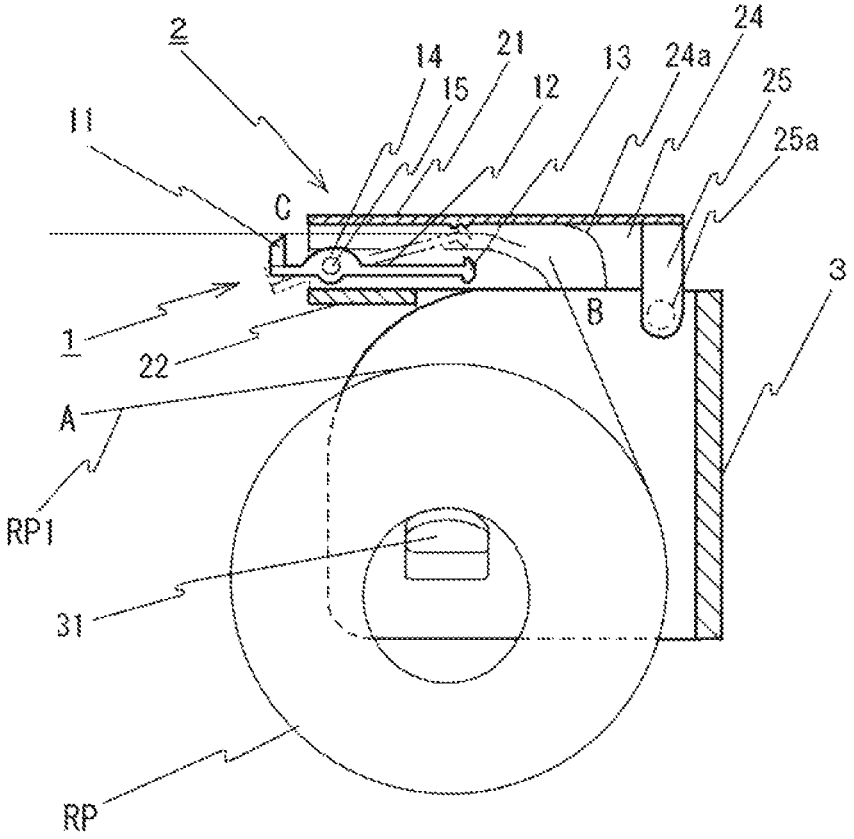
FIG. 3 is an illustration for explaining a method of attaching a roll paper to a product of the invention.

A method of attaching a roll paper to a product of the invention without any contact of a user with the product will be described with reference to FIG. 3. Preliminarily, the blade member 1 is attached to the blade-member-storing case 2 by inserting the shafts 15 of the blade member 1 into the respective holes 23*a*, 24*b*, and the connecting bars 25 of the blade-member-storing case 2 are attached to the holder body 3. First, a roll paper RP is attached to the holder body 3 with a single touch by being pushed into the holder body 3, so that the roll paper RP is supported by the roll-supporting projection pieces 31. Next, a front end RP1 of the roll paper RP is pulled out as shown by A and lifted up. The front end RP1 is pulled from the holder body 3 to an outside, for instance, to the right, and inserted into the cutout 24*a* of the right side plate 24 from a lower rear portion thereof, namely, a position of B. Subsequently, the paper RP in full width is placed above the blade member 1. The front end RP1 of the roll paper RP is pulled out to the front of the blade 11 positioned at C. Thus, the attachment and setting of the roll paper RP can be easily performed without a user touching the roll paper holder. This attachment operation can be performed with a single hand.

This state remains until the roll paper RP is used. When using the roll paper RP, a user simply pulls out the front end RP1 of the roll paper RP only by a length to be used.

Figure 4A:
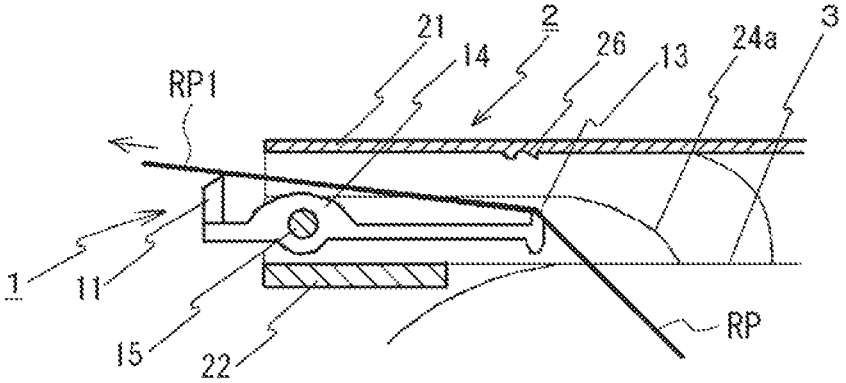
FIG. 4A is an illustration demonstrating a method of cutting a roll paper in the product of the invention.
Figure 4B:
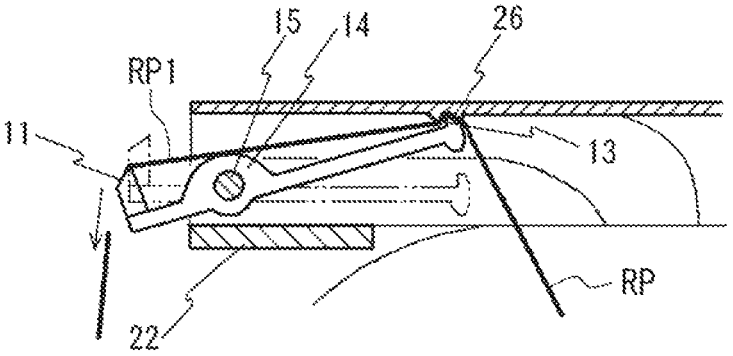
FIG. 4B is an illustration demonstrating a method of cutting a roll paper in the product of the invention.
Figure 4C:
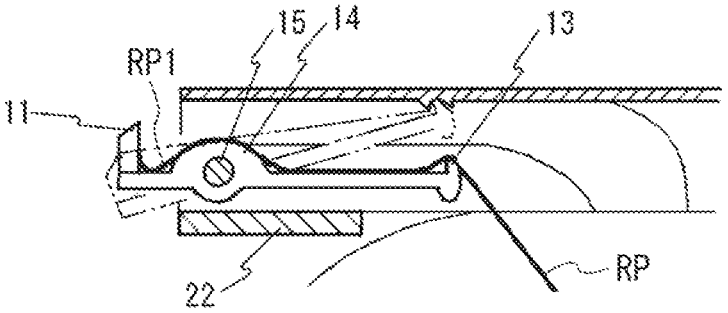
FIG. 4C is an illustration demonstrating a method of cutting a roll paper in the product of the invention.

Next, an operation of the blade member 1 for cutting the front end of the roll paper RP will be described with reference to FIGS. 4A, 4B, and 4C. Initially, the front end RP1 of the roll paper RP is pulled out by a length to be used, and pressed downward onto the blade 11 for cutting. The cutting at this time will be described in detail. The front end RP1 of the roll paper RP is pressed downward. Then, the blade member 1 is operated with the shafts 15 each serving as a fulcrum, so that the rear portion of the blade member 1 is lifted up from a state shown in FIG. 4A to a state shown in FIG. 4B. Simultaneously, the press projection 13 is engaged with the receiving portion 26, whereby the roll paper RP is stationarily held between the press projection 13 and the receiving portion 26. Accordingly, the front end RP1 of the roll paper RP is reliably cut with the blade 11. In another exemplary embodiment, the roll paper RP is made stationary by being held between the press projection 13 and the top cover 21.

After the roll paper RP is cut, the press projection 13 and the receiving portion 26 are disengaged from each other. Accordingly, a front end of the roll paper RP left after the cutting is placed on the convex portion 14 as shown in FIG. 4C. Unlike a typical manner, the front end of the roll paper RP is not placed on a flat surface in a clinging manner, but softly placed on the convex portion 14. Consequently, the front end RP1 of the roll paper RP can be found easily by any user and can be easily pinched with fingers to enable an easy pulling-out of a length to be used.

The invention is applicable to not only a roll paper for toilet but also a roll paper for other usage, resulting in attachment and cutting without contact in the same manner as the above.

Japanese Patent Application Nos. 2020-73798 filed Apr. 17, 2020 and 2021-32219 filed Mar. 2, 2021 are hereby expressly incorporated by reference herein in their entireties.

What is claimed is:

1. A roll paper holder comprising:

a blade member comprising a blade provided at an end of a base, a press projection provided at another end of the base, and a convex portion provided on an upper surface of the base, the convex portion having a shaft at opposing ends thereof;

a blade-member-storing case configured for receipt of the blade member; and a holder body to which a roll paper is attachable, wherein the shafts at the opposing ends of the convex portion are attached to the blade-member-storing case such that the blade member is pivotable relative to the blade-member-storing case:

the blade-member-storing case is mounted on an upper surface of the holder body with a base end pivotally supported by the holder body, and the blade-member-storing case has a cutout in a side thereof, the cutout being curved from a front end of the side to a lower portion of the side close to the base end of the blade-member-storing case.

2. The roll paper holder according to claim 1, wherein the blade-member-storing case comprises:

a top cover;

a support plate disposed under the top cover;

a first side plate disposed on a first side of the top cover;

a second side plate disposed on a second side of the top cover and having the cutout; and a connecting bar extending downward from the top cover and being pivotally supported by the holder body.

3. The roll paper holder according to claim 2, further comprising: a receiving portion with which the press projection of the blade member is engageable, the receiving portion being formed on a lower surface of the top cover of the blade-member-storing case.

4. The roll paper holder according to claim 1, wherein the blade-member-storing case comprises:

a top cover having an upper step;

a support plate disposed under the top cover;

a first side plate disposed on a first side of to the top cover;

a second side plate in a form of a projection piece disposed on a second side of the top cover;

a connecting bar extending downward from the top cover and being pivotally supported by the holder body; and a guide for a roll paper that is provided at an end of the support plate opposite to the first side plate, and the guide and the first side plate each has a hole and a headed pin is attached to each of the shafts through the holes.

5. The roll paper holder according to claim 4, wherein the upper step of the top cover is smaller than a lower step in width and provided in a central portion of the lower step, and the blade and the base define a clearance therebetween that fingers enter to facilitate pinching a front end of the roll paper.

* * * * *